United States Patent [19]

Bankstahl

[11] Patent Number: 4,898,553

[45] Date of Patent: Feb. 6, 1990

[54] MARINE DRIVE UNIT WITH REDUCED DRAG

[75] Inventor: Herbert A. Bankstahl, Fond du Lac, Wis.

[73] Assignee: Brunswick Corporation, Skokie, Ill.

[21] Appl. No.: 180,045

[22] Filed: Apr. 11, 1988

[51] Int. Cl.[4] ..... B63H 21/10

[52] U.S. Cl. ..... 440/76; 440/900; 440/78

[58] Field of Search ..... 440/76, 77, 78, 75, 440/900

[56] References Cited

U.S. PATENT DOCUMENTS

| | | | |
|---|---|---|---|
| 1,890,879 | 12/1932 | Johnson et al. | 440/78 |
| 2,021,309 | 11/1935 | Irgens | 440/78 |
| 4,636,175 | 1/1987 | Frazzell et al. | 440/88 |

*Primary Examiner*—Sherman D. Basinger
*Assistant Examiner*—E. L. Swinehart
*Attorney, Agent, or Firm*—Andrus, Sceales, Starke & Sawall

[57] ABSTRACT

A marine drive (2) includes a lower drive unit (4) having a strut portion (6) and a torpedo portion (10) which are blended along a blended portion (30) such that all horizontal cross-sections through the blended portion and the strut portion have outer profiles defining smooth continuous non-concave surface elements continuously curved convex along the entire front to back length thereof, and such that all vertical cross-sections through the strut portion, blended portion and torpedo portion have outer profiles defining a central zone (62) of concave outer surface elements wherein the degree of concave curvature continually increases front to back.

8 Claims, 2 Drawing Sheets

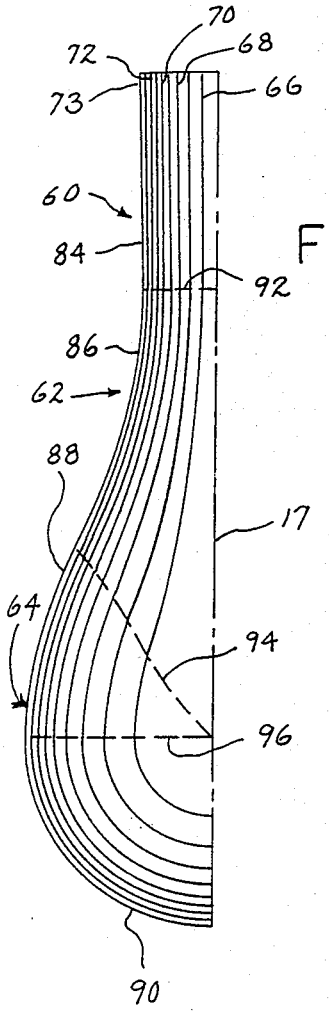
FIG. 3
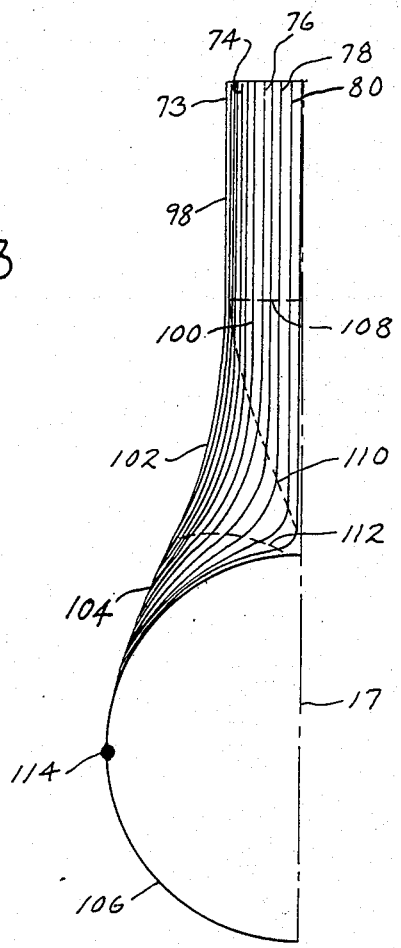
FIG. 4
FIG. 5
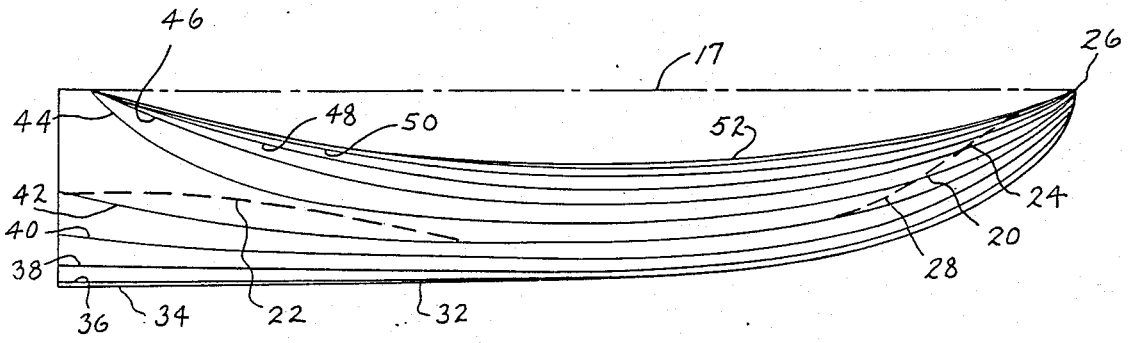

MARINE DRIVE UNIT WITH REDUCED DRAG

BACKGROUND AND SUMMARY

The invention relates to marine drive units, and more particularly to improvements affording reduced drag.

A marine drive includes a lower drive unit near of the transom of a boat and having a vertical depending strut portion with at least one vertical drive shaft and having a lower horizontal torpedo portion with at least one horizontal propeller shaft carrying at least one rear propeller.

The present invention provides improvements in the blending or fairing between the strut and torpedo shapes to optimize the upper surface piercing shape and the lower submerged shape in combination. In accordance with the invention, drag is reduced by eliminating concave outer surface profiles in horizontal cross-sections through the blended portion between the strut portion and the torpedo portion. In the preferred embodiment, all horizontal cross-sections through such blended portion have outer surface profiles which are continuously curved convexly along the entire front to back length thereof. Vertical cross-sections have central zones of concave outer surface profiles whose degree of concave curvature continually increases front to back such that the largest radius of such concave curvature along the vertical cross-section outer profile is at the front of the blended portion.

BRIEF DESCRIPTION OF THE DRAWINGS

FIG. 3 is a view from the front of the lower drive unit of FIG. 2 shows multiple vertical cross sections.

FIG. 4 is a view from the rear of the lower drive unit of FIG. 2 showing multiple vertical cross sections.

FIG. 5 is a view from the top of the drive unit in FIG. 2 showing multiple horizontal cross sections.

FIGS. 2, 3, 4 and 5 show profiles of one half of a symmetrically shaped lower drive unit, central plane 17 being the plane of symmetry.

DETAILED DESCRIPTION

Figure 1:
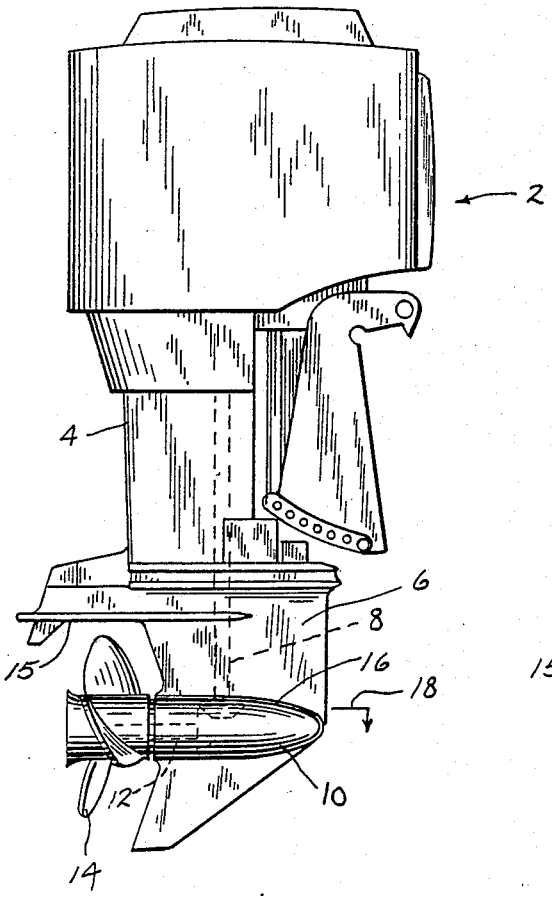
FIG. 1 shows a marine drive as known in the art.

FIG. 1 shows a marine drive 2 including a lower drive unit 4 near the transom of a boat (not shown) and having a vertical depending strut portion 6 with a vertical drive shaft 8 and having a lower horizontal torpedo portion 10 with a horizontal propeller shaft 12 carrying a rear propeller 14. Anti-ventilation plate 15 on strut portion 6 is spaced above torpedo portion 10 and propeller 14 and extends laterally horizontally outwardly from strut portion 6 to prevent entry of air to propeller 14. Strut portion 6 and torpedo portion 10 are blended at a blended portion 16.

Viewing a horizontal cross-section through blended portion 16 as shown at section line 18, it is typical in the prior art that the outer profile of such horizontal cross-section have a concave surface profile 20, as shown in dashed line in FIG. 5, near the front of the blended portion, and a concave outer surface profile 22 near the rear of the blended portion. Such concave surfaces increase drag, due to the greater horizontally outward acceleration required of the water as it leaves the concave area 24. The leading tip 26 of such surface does not cause increased drag, however once the water reaches and flows past area 24 of the surface, the water must be rapidly accelerated outwardly, thus causing increased drag. The change in direction of water flow from convex curvature at leading tip 26 to concave curvature at area 24 and back to convex curvature at area 28 also increases drag. This change in direction of curvature of water flow also occurs at the rear at area 22, and additionally increases drag.

Figure 2:
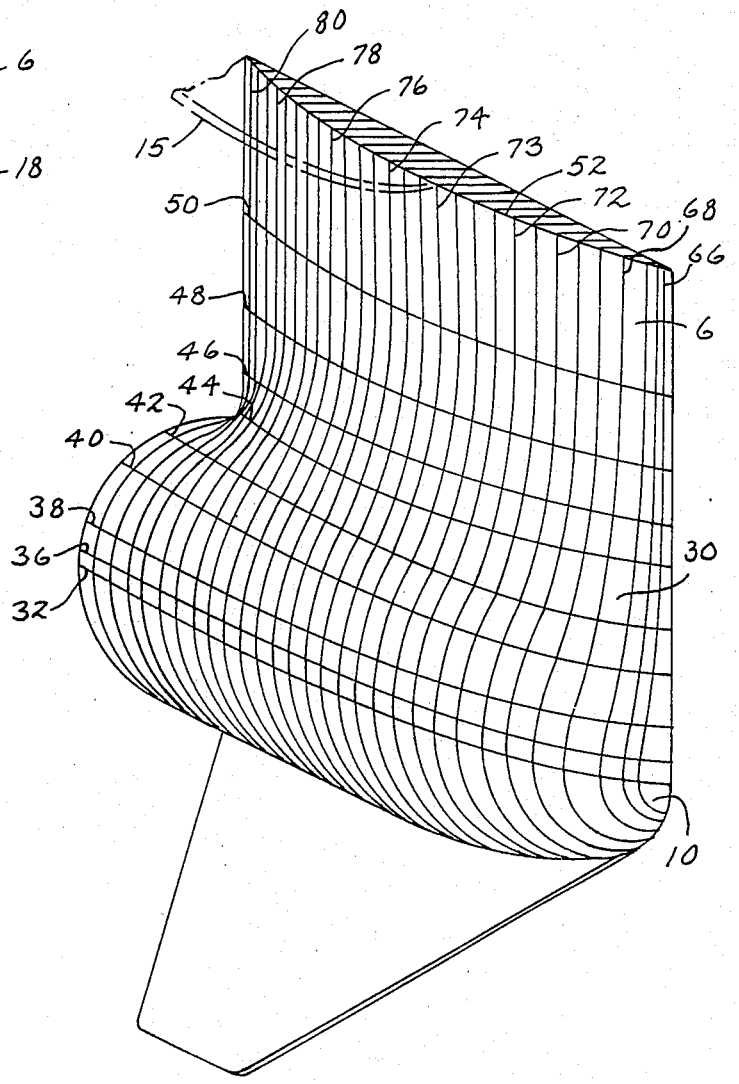
FIG. 2 shows a perspective view of a marine lower drive unit with various outer profile contour surface lines.

In the present invention, strut portion 6 and torpedo housing 10 have outer profiles which are blended along blended portion 30, FIG. 2, such that all horizontal cross-sections through the blended portion have outer profiles defining smooth continuous non-concave surface elements extending from the front of blended portion 30 rearwardly to at least the maximum width thereof. In preferred form, all horizontal cross-sections through blended portion 30 have outer profiles defining smooth continuous non-concave surface elements which are continuously curved convexly along the entire front to back length thereof. Furthermore, all horizontal cross-sections through strut portion 6 between torpedo portion 10 and anti-ventilation plate 15 also have outer profiles defining smooth continuous non-concave surface elements extending from the front of the strut portion rearwardly to at least the maximum width thereof. In preferred form, all horizontal cross-sections through the strut portion have smooth continuous non-concave outer surface elements continuously curved convexly along the entire front to back length thereof. Lower gearcase strut portions with horizontal cross-sections, whose outer surface profiles continuously curve convexly along the entire front to back length thereof are known in the art.

FIG. 5 shows at surface 32 the outer profile of the horizontal cross section through the middle of the torpedo housing. The rear section 34 of such profile extends straight back. The remaining horizontal cross sections thereabove have outer surface profiles which are continuously curved convexly from front to back, without concave inflections such as at 20 or 22. Other outer profiles are shown at 36, 38, 40, 42, 44, 46, 48, 50 and 52, progressing upwardly in FIG. 2 and as correspondingly shown in FIGS. 2 and 5. The cross-section at 52 is just beneath anti-ventilation plate 15.

Strut portion 6 and torpedo portion 10 have outer profiles which are blended along blended portion 30 such that vertical cross-sections through strut portion 6, blended portion 30 and torpedo portion 10 have outer profiles defining an upper zone 60, FIG. 3, of substantially straight vertical outer surface profiles, a central zone 62 of concave outer surface profiles, and a lower zone 64 of convex outer surface profiles, all as taken along the vertical cross-sections. The degree of concave curvature of outer surface profiles of central zone 62 continually increases front to back such that the outer surface profiles along the vertical cross-sections of blended portion 30 are substantially more concavely curved at the rear than at the front, i.e. there is a larger radius of concave curvature at the front than at the rear.

The vertical cross-sections shown in FIG. 3 have outer surface profiles such as 66, 68, 70, 72, etc., corresponding to the like numbered surfaces in FIG. 2. Likewise, when viewed from the rear in FIG. 4, the vertical cross-sections having outer profiles shown at 74, 76, 78, 80, etc., have the correspondingly like numbered surfaces as shown in FIG. 2. Profile 73 is shown in both FIGS. 3 and 4 and is at the widest width. Strut portion 6, blended portion 30 and torpedo portion 10 are blended vertically along a front section as shown in FIG. 3, and along a rear section as shown in FIG. 4.

All vertical cross-sections through the front section in FIG. 3 have a first upper zone 84 having outer profiles defining substantially straight vertical surface elements, a second next lower zone 86 having outer profiles defining concave surface elements, a third next lower zone 88 having outer profiles defining convex surface elements, and a fourth next lower zone 90 having outer profiles defining convex surface elements of equal or smaller radius of curvature than the convex surface elements of third zone 88. First zone 84 meets second zone 86 for each of the profiles at transition points between straight line and concave curvature for each of the profiles, and the locus of all such transition points between zones 84 and 86 forms a smooth continuous line 92. Second zone 86 meets third zone 88 for each of the profiles at transition points between concave and convex curvature for each of the profiles, and the locus of all such transition points between zones 86 and 88 forms a smooth continuous line 94. Third zone 88 meets fourth zone 90 for each of the profiles at transition points from convex to equal or more sharply convex curvature for each of the profiles, and the locus of all such transition points between zones 88 and 90 forms a smooth continuous line 96.

All vertical cross-sections through the rear section shown in FIG. 4 have a first upper zone 98 having outer profiles defining substantially straight vertical surface elements, a second next lower zone 100 having outer profiles defining slightly concave surface elements, a third next lower zone 102 having outer profiles defining concave surface elements of smaller radius of curvature than said concave profiles of said second zone, a fourth next lower zone 104 having outer profiles defining convex surface elements, and a fifth next lower zone 106 having outer profiles defining convex surface elements of equal or smaller radius of curvature than said convex profiles of said fourth zone. First zone 98 meets second zone 100 for each of the profiles at transition points between straight line and concave curvature for each of the profiles, and the locus of all such transition points between zones 98 and 100 forms a smooth continuous line 108. Second zone 100 meets third zone 102 for each of the profiles at transition points from concave to more sharply concave curvature for each of the profiles, and the locus of all such transition points between zones 100 and 102 forms a smooth continuous line 110. Third zone 102 meets fourth zone 104 for each of the profiles at transition points between concave and convex curvature for each of the profiles, and the locus of all such transition points between zones 102 and 104 forms a smooth continuous line 112. Fourth zone 104 meets fifth zone 106 for each of the profiles at transition points from convex to equal or more sharply convex curvature for each of the profiles, and the locus of all such transition points forms a smooth continuous line, represented in FIG. 4, by a substantially singular point 114.

Locus lines 92 and 96 of the front section as shown in FIG. 3 extend substantially horizontally. Second locus line 94 in FIG. 3 extends diagonally and meets locus line 96 at the front of torpedo portion 10. The first locus line 108 of the rear section as shown in FIG. 4 extends substantially horizontally. The second locus line 110 of the rear section extends diagonally and may be slightly curved. Third locus line 112 of the rear section extends diagonally and is curved.

The present invention thus provides continuously convex curvature of the outer surface profiles of the horizontal cross-sections through blended portion 30 in FIG. 5, in combination with greater radii of concave curvature of the central zones of the vertical cross sections of FIGS. 3 and 4. Said vertical concave curvature radii decrease continually, front to back, in surface zones 86 and 102, and are maintained sufficiently small in surface zone 100 to avoid concave portions in the surface profiles of the horizontal cross sections. The leading nose of blended portion 30 initially produces greater drag than a sharp nose. However, after the water is initially diverted horizontally outwardly away from the nose, the water flows along a continuously convexly curved path, with no directional changes in inflection which would otherwise require more rapid outward acceleration of the water, as at area 24, FIG. 5. This horizontal flow path is further facilitated by the vertical blending shown in FIGS. 3 and 4.

It is recognized that various equivalents, alternatives and modifications are possible within the scope of the appended claims.

I claim:

1. A marine drive comprising a lower drive unit near the transom of a boat and having a vertical depending strut portion with at least one vertical drive shaft and having a lower horizontal torpedo portion with at least one horizontal propeller shaft carrying at least one rear propeller, said strut portion and said torpedo portion having outer profiles which are blended along a blended portion such that vertical cross-sections through said strut portion, said blended portion and said torpedo portion have outer profiles defining an upper zone of substantially straight vertical outer surface elements, a central zone of concave outer surface profiles, and a lower zone of convex outer surface profiles, all as taken along said vertical cross-sections, and wherein the degree of concave curvature of said outer surface profiles of said central zone continually increases from the front of said blended portion to at least the maximum width thereof such that the outer surface profiles along said vertical cross-sections of said blended portion are substantially less concavely curved at the front than at the maximum width thereof.

2. A marine drive comprising a lower drive unit near the transom of a boat and having a vertical depending strut portion with at least one vertical drive shaft and having a lower horizontal torpedo portion with at least one horizontal propeller shaft carrying at least one rear propeller, said strut portion and said torpedo portion having outer profiles which are blended along a blended portion such that vertical cross-sections through said strut portion, said blended portion and said torpedo portion have outer profiles defining an upper zone of substantially straight vertical outer surface elements, a central zone of concave outer surface profiles, and a lower zone of convex outer surface profiles, all as taken along said vertical cross-sections, and wherein the degree of concave curvature of said outer surface profiles of said central zone continually increases front to back such that the outer surface profiles along said vertical cross-sections of said blended portion are substantially more concavely curved at the rear than at the front, wherein:

said strut portion, said blended portion and said torpedo portion are blended vertically along front and rear sections;

all vertical cross-sections through said front section have a first upper zone having outer profiles defining substantially straight vertical surface elements, a second next lower zone having outer profiles defining concave surface elements, a third next lower zone having outer profiles defining convex surface elements, and a fourth next lower zone having outer profiles defining convex surfaces elements of equal or smaller radius of curvature than said convex surface elements of said third zone, wherein said first zone meets said second zone for each of said profiles at transition points between straight line and concave curvature for each of said profiles and wherein the locus of all said last mentioned transition points between said first and second zones forms a smooth continuous line, and wherein said second zone meets said third zone for each of said profiles at transition points between concave and convex curvature for each of said profiles and wherein the locus of all said last mentioned transition points forms a smooth continuous line, and wherein said third zone meets said fourth zone for each of said profiles at transition points from convex curvature to equal or more sharply convex curvature for each of said profiles and wherein the locus of all said last mentioned transition points forms a smooth continuous line;

all vertical cross-sections through said rear section have a first upper zone having outer profiles defining substantially straight vertical surface elements, a second next lower zone having outer profiles defining concave surface elements, a third next lower zone having outer profiles defining concave surface elements of smaller radius of curvature than said concave surface elements of said second zone, a fourth next lower zone having outer profiles defing convex surface elements, and a fifth next lower zone having outer profiles defining convex surface elements of equal or smaller radius of curvature than said convex surface elements of said fourth zone, and wherein said first zone meets said second zone for each of said profiles at transition points between straight line and concave curvature for each of said profiles and wherein the locus of all said last mentioned transition points forms a smooth continuous line, and wherien said second zone meets said third zone for each of said profiles at transition points from concave curvature to more sharply concave curvature and wherein the locus of all said last mentioned transition points forms a smooth continuous line, and wherein said third zone meets said fourth zone for each of said profiles at trasition points between concave and convex curvature for each of said profiles and wherein the locus of all said last mentioned transition points forms a smooth continuous line, and wherein said fourth zone meets said fifth zone for each of said profiles at transition points from convex curvature to equal or more sharply convex curvature for each of said profiles and wherein the locus of all said last mentioned transition points forms a smooth continous line.

3. The invention according to claim 2 wherein:

said first and third mentioned locus lines of said front section extend substantially horizontally;

said second mentioned locus line of said front section extends diagonally and meets said third locus line of said front section at the front of said torpedo portion.

4. The invention according to claim 3 wherein:

said first mentioned locus line of said rear section extends substantially horizontally;

said second mentioned locus line of said rear section extends diagonally;

said third mentioned locus line of said rear section extends diagonally.

5. The invention according to claim 4 wherein said second mentioned locus line of said rear section extends diagonally and is curved.

6. The invention according to claim 4 wherein said third mentioned locus line of said rear section extends diagonally and is curved.

7. A marine drive comprising a lower drive unit near the transom of a boat and having a vertical depending strut portion with at least one vertical drive shaft and having a lower horizontal torpedo portion with at least one horizontal propeller shaft carrying at least one rear propeller, said strut portion and said torpedo portion having outer profiles which are blended horizontally and vertically such that all horizontal cross-sections through said blended portion have outer profiles defining smooth continuous non-concave surface elements extending from the front of said blended portion rearwardly to at least the maximum width thereof, and such that all vertical cross-sections through said blended portion have a zone of concave curvature whose degree increases from the front of said blended portion to at least the maximum width thereof such that the largest radius of said concave curvature is at said front of said blended portion.

8. The invention according to claim 7 comprising an anti-ventilation plate on said strut portion and spaced above said torpedo portion and extending laterally outwardly from said strut portion to prevent entry of air to said propeller, and wherein:

said strut portion and said torpedo portion have outer profiles which are blended along said blended portion such that all horizontal cross-sections through said blended portion have outer profiles defining smooth continuous non-concave surface elements continuously curved convexly along the entire front to back length thereof;

all horizontal cross-sections through said strut portion between said torpedo portion and said anti-ventilation plate have outer profiles defining smooth continuous non-concave surface elements continuously curved convexly along the entire front to back length thereof;

said vertical cross-sections through said strut portion, said blended portion and said torpedo portion have outer profiles defining an upper zone of substantially straight vertical outer surface profiles, a central zone of concave outer surface profiles, and a lower zone of convex outer surface profiles, and wherein the degree of concave curvature of said outer surface profiles of said central zone of said vertical cross-sections increases front to back such that the outer surface profiles along said vertical cross-sections of said blended portion are substantially more concavely curved at the rear than at the front.

* * * * *